United States Patent [19]

Dunn et al.

[11] 4,187,947

[45] Feb. 12, 1980

[54] COMBINATION MUSICAL INSTRUMENT STAND

[76] Inventors: Robert J. Dunn, 4495 Terrell Ln., Colorado Springs, Colo. 80908; Sigifred Martinez, 3815 Vaquero Cr. North, Colorado Springs, Colo. 80918

[21] Appl. No.: 905,390

[22] Filed: May 12, 1978

[51] Int. Cl.[2] ..... A47F 7/00

[52] U.S. Cl. ..... 211/13; 84/327

[58] Field of Search ..... 211/13, 195, 189, 60 R; 248/176, 460, 166, 309 A; 206/314; 84/327, 453

[56] References Cited

U.S. PATENT DOCUMENTS

| | | | |
|---|---|---|---|
| 1,661,805 | 3/1928 | Lentaty | 248/166 X |
| 2,920,851 | 1/1960 | Carlini | 84/453 X |
| 3,203,298 | 8/1965 | Sumrall | 84/453 |
| 3,357,666 | 12/1967 | Smith et al. | 248/435 X |
| 3,637,070 | 1/1972 | Friedman | 84/453 X |

*Primary Examiner*—William H. Schultz
*Assistant Examiner*—Robert W. Gibson, Jr.
*Attorney, Agent, or Firm*—W. Britton Moore

[57] ABSTRACT

A combination musical instrument stand for various woodwinds including a flat base with a hinged platform for supporting a saxophone, a hinged upright peg for sleevably receiving and vertically supporting a flute, and a two-piece interconnected and removable support for vertically positioning a clarinet thereon. The hinged platform and peg are foldable against the base, and the two-piece support is disassembled and flatly retained on the base for ready storage and/or transportation of the stand.

9 Claims, 7 Drawing Figures

COMBINATION MUSICAL INSTRUMENT STAND

This invention relates to a combination musical instrument stand for various woodwinds.

Heretofore, it has been the practice for musicians to use a variety of collapsible but cumbersome stands for supporting musical instruments, which customarily included tripod type legs, or included such a base that they were subject to be upset with incident damage to the instruments, such as, those shown in U.S. Pat. Nos. to Lang 1,888,927, Blondin 1,907,238, Smith et al 3,357,666, and Mann 3,958,786.

The principal object of the present invention is to provide a combination musical instrument stand for various woodwinds and includes a flat base with a hinged platform for supporting a saxophone, a hinged upright peg for sleevably receiving and vertically supporting a flute, and a two-piece interconnected and removable support for vertically positioning a clarinet thereon.

Another object is the provision of a generally rectangular flat base with a hinged platform movable to and retained at an angle thereon for angularly and vertically supporting a saxophone.

A further object is the provision of a hinged peg tiltable to an upright position and lockable thereat for vertically supporting a flute.

Still another object is to provide a separable and slidably interfitting and interlockable two-piece support removably retained in upright position for vertically positioning a clarinet thereon.

A still further object is to provide a combination musical instrument stand wherein the saxophone supporting platform and flute supporting peg are hinged for folding flatly against the base, and the two-piece clarinet support is disassembleable and flatly positioned and retained on the base so as to permit storage and/or transportation when not in use.

Another object is the provision of a combination musical instrument stand adaptable for supporting woodwind instruments in positions readily accessible to a musician for independent use, such as, in a common woodwind doubling situation requiring performance upon a saxophone, clarinet, or flute alternately.

A further object is to privide a relatively small and compact stand inexpensively produceable from lightweight transparent plastic, and which will securely support woodwind instruments at a lowered center of gravity and with increased stability.

These and other objects and advantages will be apparent as the specification is considered with the accompanying drawings, wherein FIG. 1 is a perspective view of the combination musical instrument stand with saxophone, flute and clarinet woodwind instruments supported thereon;

Figure 1:
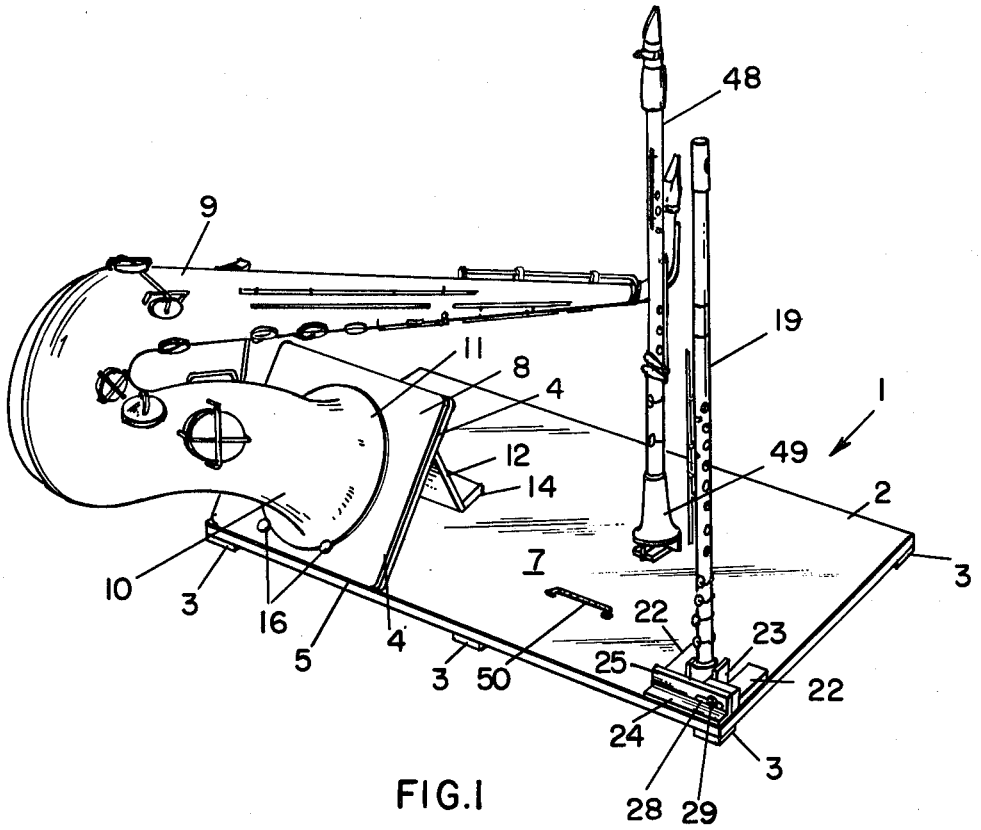

Referring more particularly to the drawings, wherein similar reference characters designate like parts throughout the several views, and with particular reference to FIG. 1, the stand 1 hereof includes a generally flat rectangular base 2 having suitable flat supporting pads or feet 3 on its underside at the corners and midportion thereof. The base may be of any suitable rigid but lightweight material, such as, transparent plexiglas or other plastic or metal.

Arranged at one end of the base, in a corner thereof, is a flat rectangular platform 4 hinged on its underside along one edge 5, as at 6, to the upper surface 7 of the base. Platform 4 may be of th4 same material as the base and has a black coating 8 on its upper surface to add to the decor and prevent marring thereof when the rim 11 of the bell 10 of a saophone 9 is positioned and supported thereon, as presently described. Spaced inwardly from hinge 6 is a prop 12, which may be of the same material and the same width as platform 4 and is hinged, as at 13, to the underside of the platform so as to freely swing downwardly therefrom when the latter is tilted upwardly to the approximately thirty-seven (37°) degree angled position of FIG. 1. When the platform is so elevated, the lower edge of prop 12 will be moved into abutting engagement with a flat stop 14, adhesively or otherwise suitably secured to the upper surface of the base 2, so that the platform is retained in raised or tilted position. It will, of course, be apparent that the latter may be caused to flatly engage the base by swinging the prop 12 away from the stop 14 and lowering the same against the base. A pair of knob-like posts 15 with enlarged heads 16 are suitably spacedly and fixedly anchored on and project upwardly from the upper surface 7 of the base, adjacent edge 5 thereof. When the platform is in elevated position, the rim 11 of the saxophone bell 10 may be fitted under the post heads 16 so that the bell will rest against and be supported by the platform, as in FIG. 1.

Figure 3:
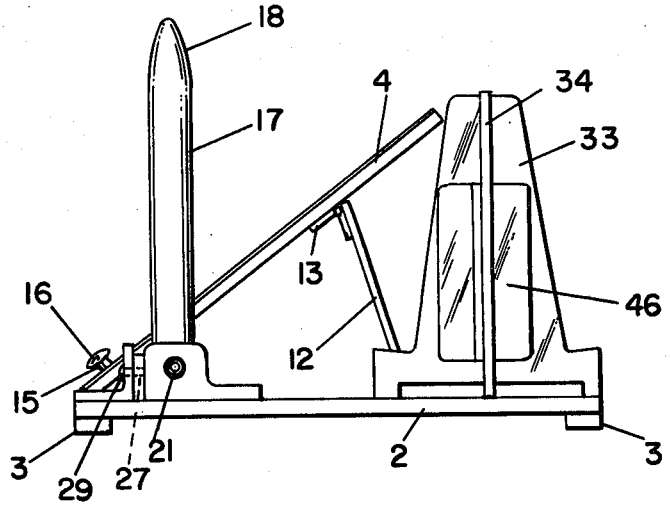
FIG. 3 is an end elevation, viewed from the right hand end of FIG. 1, with instruments removed.
Figure 4:
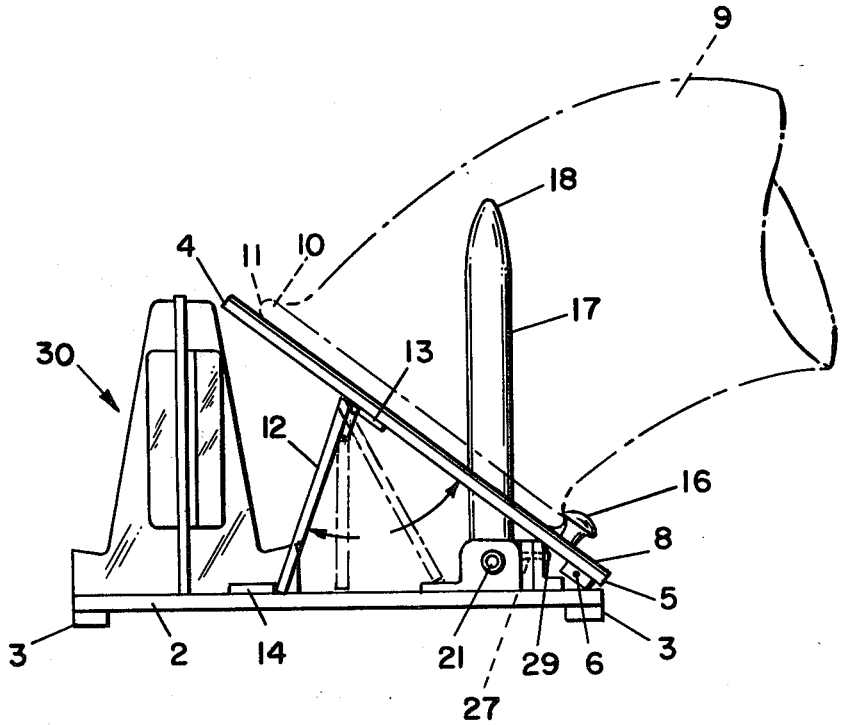
FIG. 4 is an end elevation, viewed from the left hand end of FIG. 1, with part of a saxophone supported thereon.
Figure 7:
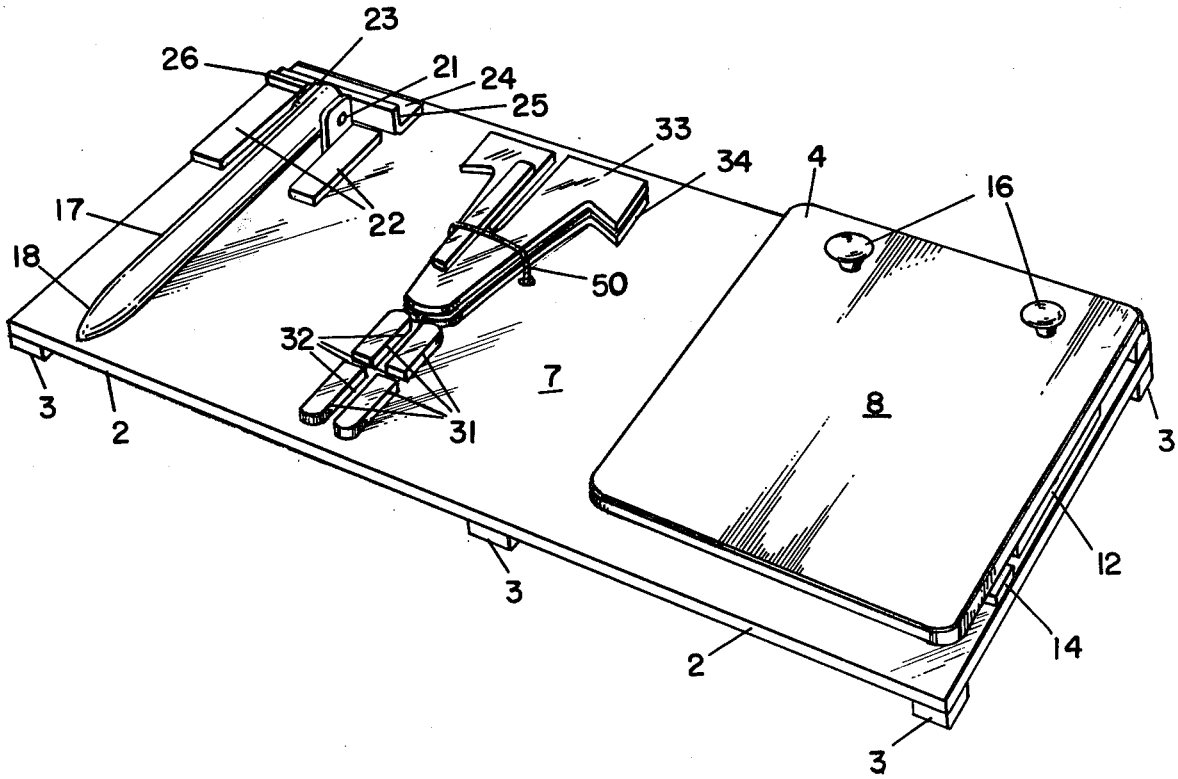
FIG. 7 is a perspective view of the stand base with the hinged saxophone platform and flute peg folded flat against the base, and the two-piece clarinet support disassembled from and flatly supported on the base.

Arranged at the front left corner of base 2, viewing FIGS. 1 and 3, and spaced forwardly of the saxophone supporting platform 4, is an upright flute supporting peg 17 having a tapered and rounded upper end 18 over which the bell, not shown, of a flute 19 is sleeved so as to be vertically supported on the base, as in FIG. 1. The peg 17 is pivotally arranged, as at 21, at its lower end between upstanding spaced ears 23 on two flat spaced strips 22, adhesively or otherwise suitably secured to the upper base surface 7. Another strip 24 having an upstanding inner wall 25, is similarly attached to surface 7, at right angles to and spaced from the ends of strips 22. A slide lock bar 26 is arranged parallel to the inner side and in flat engagement with wall 25, so as to be positioned in the gap between the strips. A screw 27, projecting laterally from slide bar 26, extends through an elongated slot 28 in side wall 25 and is retained for sliding movement thereagainst by enlarged screw head 29. Thus, when the slide bar 26 is moved inwardly, it will block pivotal movement of the lower end of peg 17, but, when slid outwardly, in the opposing direction, the lower end of the peg may swing toward side wall 25 and permit of the peg swinging downwardly into folded position against the base, as shown in FIG. 7, for storage purposes. The peg 17 and its supporting strips and slide lock may be formed of the same material as the base and saxophone supporting platform.

Figure 5:
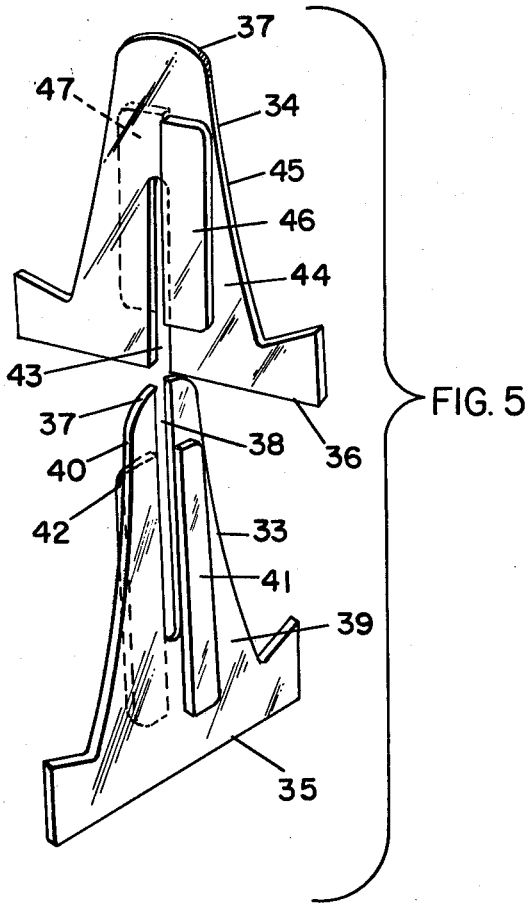
FIG. 5 is an exploded view of the two-piece clarinet support.
Figure 6:
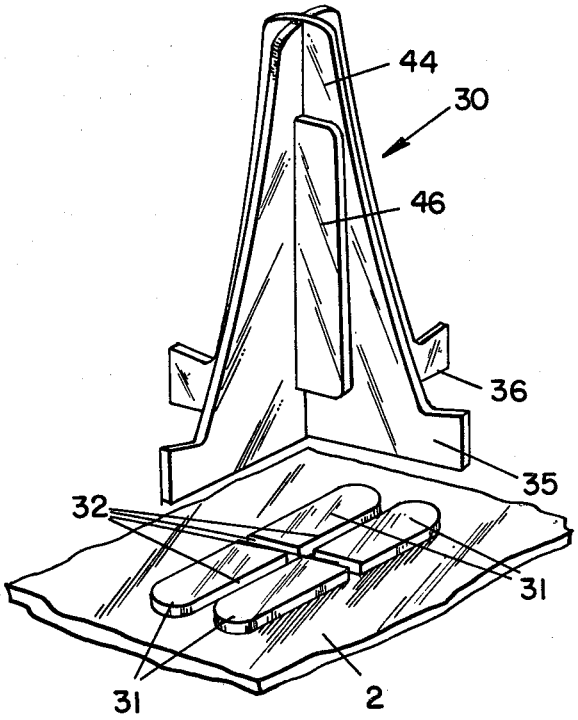
FIG. 6 is a perspective view of the clarinet support ready to be fixedly supported on the base.

As will best be illustrated in FIGS. 5–7, a clarinet support 30 is removably arranged on upper base surface 7, between and offset to one side of the saxophone and flute supports. Thus, four flat, generally rectangular, strips 31 are parallely disposed on and adhesively, or otherwise suitably attached to surface 7, and are so spaced from each other to provide right angularly disposed slots or grooves 32 therebetween. Support 30 includes two flat, generally pyramidal shaped members 33 and 34 having relatively wide base portions 35 and 36, each tapering upwardly to reduced and rounded apexes 37.

Figure 2:
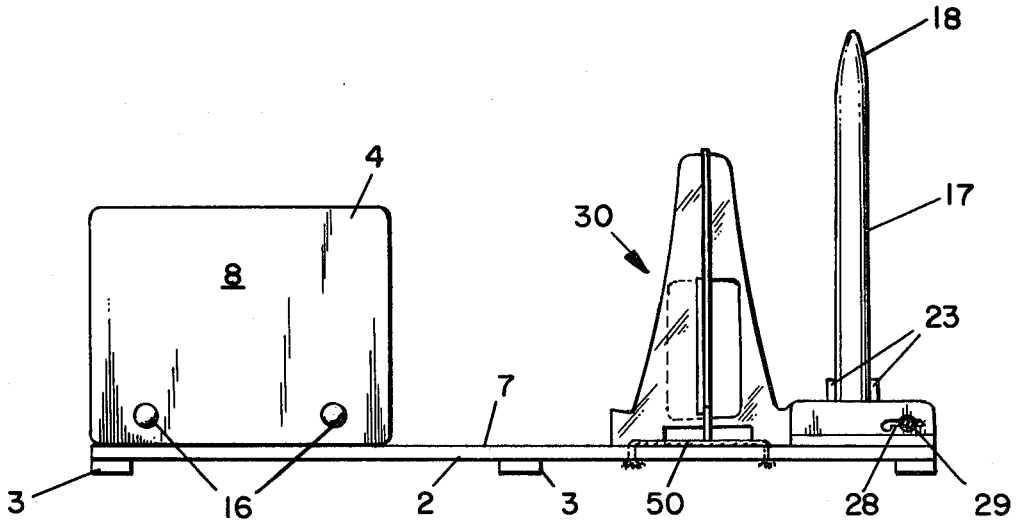
FIG. 2 is a side elevation, viewed from the left of FIG. 1, with instruments removed.

Member 33 is formed with an elongated slot 38 extending from apex 37 downwardly to a point substantially midway between the apex and base 35. Slot 38 has a flat narrow guide strip 41, adhesively secured to face 39 at one side thereof, and the other face 40 has a similar guide strip 42, adhesively secured thereto at the opposite side of slot 38, so the guide strips 41–42 are offset. Member 34 has a similar slot 43 extending upwardly from its base 36 to a midway point between the base and apex 37, which slot 43 has corresponding flat guide strips 46–47, adhesively and offsetedly secured to faces 44–45, as previously described. Thus, in FIGS. 5–6, members 33–34 are arranged at right angles to each other, and member 34 is slipped downwardly in the slot 38 and interfitted with member 33 so as to be retained together by slots 38–43 and associated guide strips 41–42. As the base portions 35–46 are on the same horizontal plane, they will interfit the slots 32 between base strips 31. When so interconnected, it will be evident that clarinet support 30 will be retained in a secure upright position, as in FIGS. 1, 2 and 3, and a bell 49 of a clarinet 48 may be sleeved thereover and supported thereon in an upright position. The clarinet supporting members 33–34 and associated guiding strips and base supporting strips may be formed of the same material as the base, saxophone and flute supporting members.

For storage purposes, and with the clarinet removed therefrom, it is only necessary to lift the interconnected members 33–34 from base slots 32 and disassemble the same for flat stacking upon upper base surface 7, where they may be positioned under an elastic cord or the like 50 and retained thereon, as best shown in FIG. 7. The base may then be stored for transportation in a suitable instrument case or the like, not shown.

While a preferred embodiment of combination musical instrument stand has been shown and described, it is to be understood that various changes and improvements may be made therein without departing from the scope and spirit of the appended claims.

What I claim is:

1. A combination musical stand for various woodwinds including saxophone, flute, and clarinet, comprising a flat base, platform means on said base, said platform including means to support said saxophone, said platform being hingedly mounted on said base for angular tilting movement relative thereto for angularly and generally vertically supporting a saxophone, said platform being foldable against said base for storage, peg means on said base and spaced from said platform, said peg means being hinged at its lower end to said base so as to project vertically for receiving a flute thereon and being foldable to a horizontal position relative to said base for storage, and pyramidal shaped means removably positioned on said base in spaced relation to said platform and peg for vertically receiving a clarinet thereon, and said pyramidal shaped means being removed for flat stacking on said base for storage of the stand.

2. A combination musical stand for various woodwinds, as defined in claim 1, wherein said base is generally rectangular and said platform is arranged thereon adjacent a side edge of said base and is hinged thereat whereby the inner end of said platform will tilt angularly upwardly for supporting the bell end of a saxophone thereon.

3. A combination musical stand for various woodwinds, as defined in claim 2, wherein said platform is flat and has spaced upstanding posts on the upper face thereof adjacent said hinged side edge for engaging with and supporting the bell end of a saxophone thereon.

4. A combination musical stand for various woodwinds, as defined in claim 3, wherein said posts have enlarged knob-like heads thereon for receiving the rim of the saxophone bell end thereunder and supporting it thereon, and hinged prop means on the underside of said platform for retaining the platform in angular elevated position.

5. A combination musical stand for various woodwinds, as defined in claim 1, wherein slidable lock bar means is associated with the hinged lower end of said peg means and is slidably movable thereagainst for locking said peg means in vertical flute supporting position.

6. A combination musical stand for various woodwinds, as defined in claim 1, wherein said base, hinged platform, hinged peg, and said removably pyramid-shaped means are formed of transparent plastic.

7. A combination musical stand for various woodwinds, as defined in claim 1, wherein said pyramidal-shaped means includes two generally right angularly positioned relatively thin flat members having wide base portions tapering upwardly to reduced apexes, said members being slotted for slidable interfitting into a vertical clarinet receiving and supporting position.

8. A combination musical stand for various woodwinds, as defined in claim 7, wherein slotted means is arranged on said base, said base portions of said flat members being removably received in said slotted means for anchoring said assembled members vertically on said base.

9. A combination musical stand for various woodwinds, as defined in claim 8, wherein said slotted means includes parallel strips arranged on said base, said strips being spaced apart to provide right angularly extending and intersecting slots for receiving said flat member base portions therein, said flat members being adapted to be slidably disassembled for flat stacking on said base, and flexible cord means anchored in said base for receiving and retaining said stacked members thereunder and against said base for storage.

* * * * *